US006620303B2

(12) United States Patent
Wong et al.

(10) Patent No.: US 6,620,303 B2
(45) Date of Patent: Sep. 16, 2003

(54) PROCESS FOR MAKING NICKEL ELECTROFORMS

(75) Inventors: Kam Po Wong, Kowloon (HK); Kang Cheung Chan, Kowloon (HK); Tai Man Yue, Kowloon (HK)

(73) Assignee: Hong Kong Polytechnic University, Kowloon (HK)

( * ) Notice: Subject to any disclaimer, the term of this patent is extended or adjusted under 35 U.S.C. 154(b) by 45 days.

(21) Appl. No.: 09/860,758

(22) Filed: May 21, 2001

(65) Prior Publication Data

US 2002/0170826 A1 Nov. 21, 2002

(51) Int. Cl.[7] ..... C25D 5/18
(52) U.S. Cl. ..... 205/67; 205/104
(58) Field of Search ..... 205/67, 96, 102, 205/104

(56) References Cited

U.S. PATENT DOCUMENTS

| | | | | | |
|---|---|---|---|---|---|
| 4,468,293 | A | * | 8/1984 | Polan et al. | 156/151 |
| 5,326,454 | A | * | 7/1994 | Engelhaupt | 205/103 |
| 6,099,711 | A | * | 8/2000 | Dahms et al. | 205/101 |
| 6,197,179 | B1 | * | 3/2001 | Arlt et al. | 205/108 |
| 6,409,903 | B1 | * | 6/2002 | Chung et al. | 204/229.5 |

* cited by examiner

*Primary Examiner*—Roy King
*Assistant Examiner*—William T. Leader
(74) *Attorney, Agent, or Firm*—Leydig, Voit & Mayer, Ltd.

(57) ABSTRACT

It is known to apply a pulse current during electrodeposition of nickel. In the invention, pulse current waveforms have ramp-down spikes leading to improvements in surface finishes of electroforms created by the process.

9 Claims, 6 Drawing Sheets

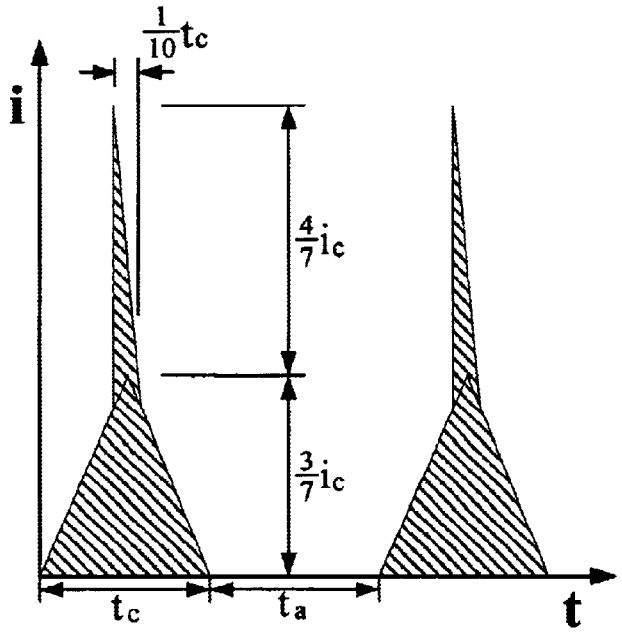

FIGURE 4

Table 1

| Cathodic Peak Current Density (mA/cm2) | Type of Waveform | Change of Surface Roughness (micrometer) |
|---|---|---|
| 500 | *W*rec | 0.175 |
| | *W*rdn | 0.140 |
| | *W*tri | 0.155 |
| | *W*rec,s | 0.082 |
| | *W*rdn,s | 0.050 |
| | *W*tri,s | 0.065 |

Remarks:

*W*rec Rectangular waveform without spike
*W*rdn Ramp-down waveform without spike
*W*tri Triangular waveform without spike
*W*rec,s Rectangular waveform with spike
*W*rdn,s Ramp-down waveform with spike
*W*tri,s Triangular waveform with spike

FIGURE 9

PROCESS FOR MAKING NICKEL ELECTROFORMS

BACKGROUND OF THE INVENTION

1. Field of the Invention

The invention relates to nickel electroforms.

2. Description of Prior Art

Nickel electrodeposition processes are well-known and pulse currents with rectangular waveforms, instead of direct current, are commonly used to enhance deposition quality. The quality and repeatability of surface finishes provided by this process, especially to meet the requirements of modern micro-device products, has generated many proposals that are generally focussed on using different rectangular waveforms. It has however been proposed to use other types of waveforms in a Paper published in Surface Coatings & Technology 115 (1999) 132–139 entitled 'A study of surface finishing in pulse current electroforming of nickel by utilising different shaped waveforms'. However, repeatable extremely high quality surface finishes have not yet been attained.

SUMMARY OF THE INVENTION

It is an object of the invention to overcome or at least reduce this problem.

According to the invention there is provided a nickel electrodisposition process for creating electroforms having extremely high quality surface finishes, the process comprising applying pulses of direct current in which each pulse has a waveform with a ramp-down spike.

Each waveform may have a ramp-down spike in a rectangular waveform, in a triangular waveform, or, preferably, in a ramp down waveform.

BRIEF DESCRIPTION OF THE DRAWINGS

Processes according to the invention will now be described by way of example with reference to the accompanying drawings in which:

FIG. 4 is a current time graph showing a third waveform of pulses applied during electroforming;

FIG. 9 is Table 1 showing comparisons of surface finishes using the described methods.

DESCRIPTION OF THE PREFERRED EMBODIMENTS

Figure 1:
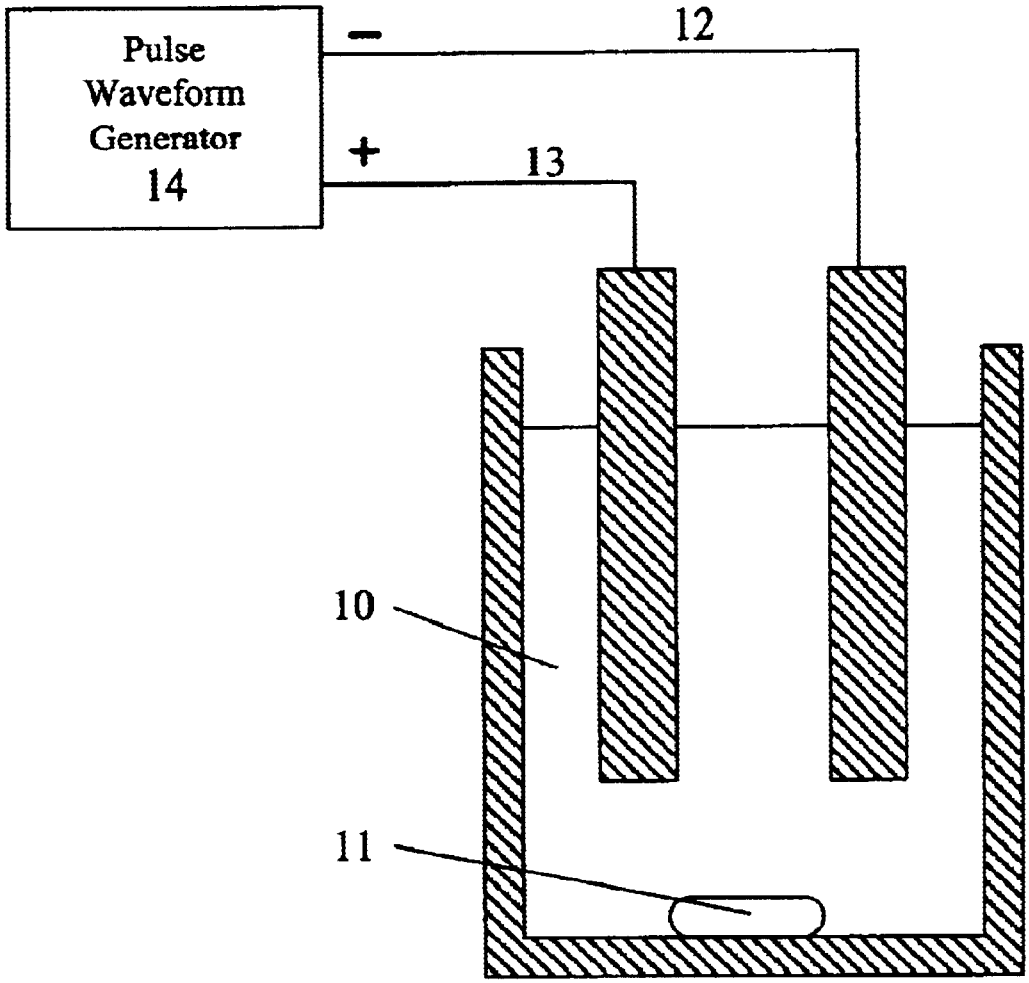
FIG. 1 is a schematic layout of apparatus for carrying out the processes.

Referring to the drawings, in FIG. 1 a conventional electroforming bath 10 has a magnetic stirrer 11 and two electrodes 12 and 13. The cathode 12 and anode 13 are supplied with pulsed current of different shaped waveforms from a pulse waveform generator 14 in a manner explained below.

The bath solution was nickel sulphamate 330 g/l, nickel chloride 15 g/l, boric acid 30 g/l and sodium dodecyl sulphate 0.2 g/l. The temperature was kept at 50±1°C. The initial pH of the electrolyte was 4.2, which is typical for electroforming. The cathode mandrel electrode was made of polished stainless steel and had dimensions of 100×3×1 mm. Electroforming processes were carried out using different shaped current pulses, as explained below.

Figure 2:
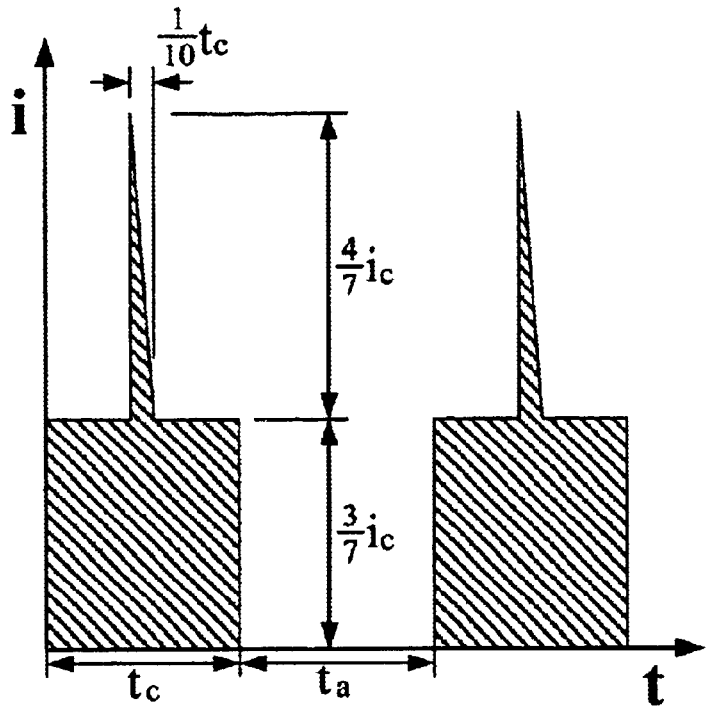
FIG. 2 is a current time graph showing a first waveform of pulses applied during electroforming.
Figure 3:
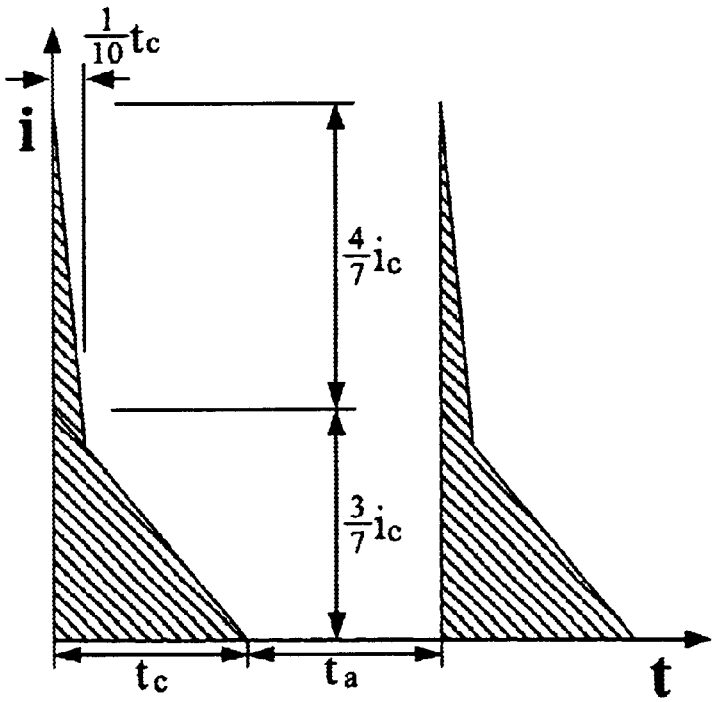
FIG. 3 is a current time graph showing a second waveform of pulses applied during electroforming.

The current pulses were each provided with repetitive ramp down spikes, which is a characteristic of embodiments of this invention. The preferred forms of each of the waveforms is shown in FIGS. 2 to 4. In the Figures, $i_c$ is the cathodic peak current density, $t_a$ is the pause time, and $t_c$ is the cathodic time. Typically in the Figures, the maximum $i_c$ is 500 mA/cm$^2$, and $t_c$ and $t_a$ are equal to Sins. The waveforms represent the applied conditions in each case.

Figure 5:
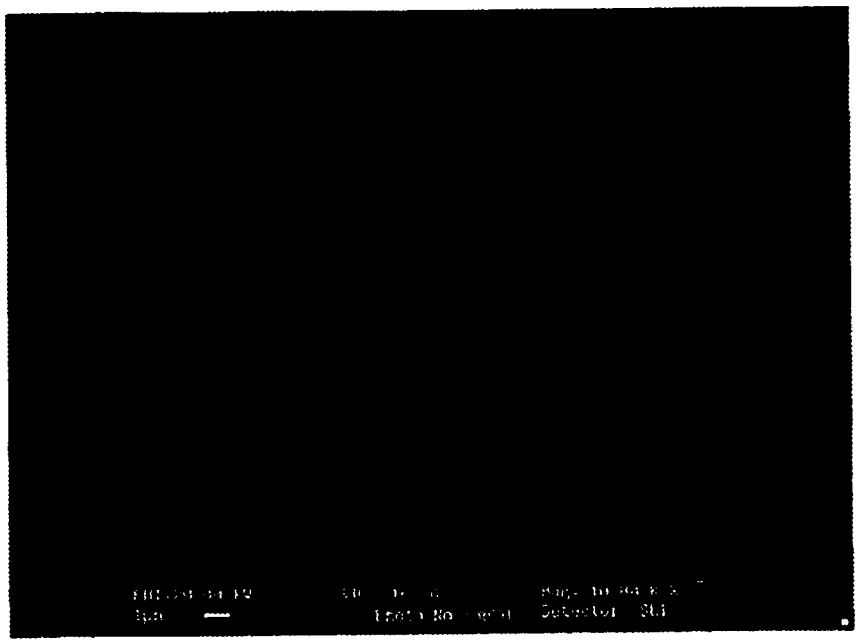
FIG. 5 illustrates the surface of an electroform after applying pulses of the first waveform.
Figure 6:
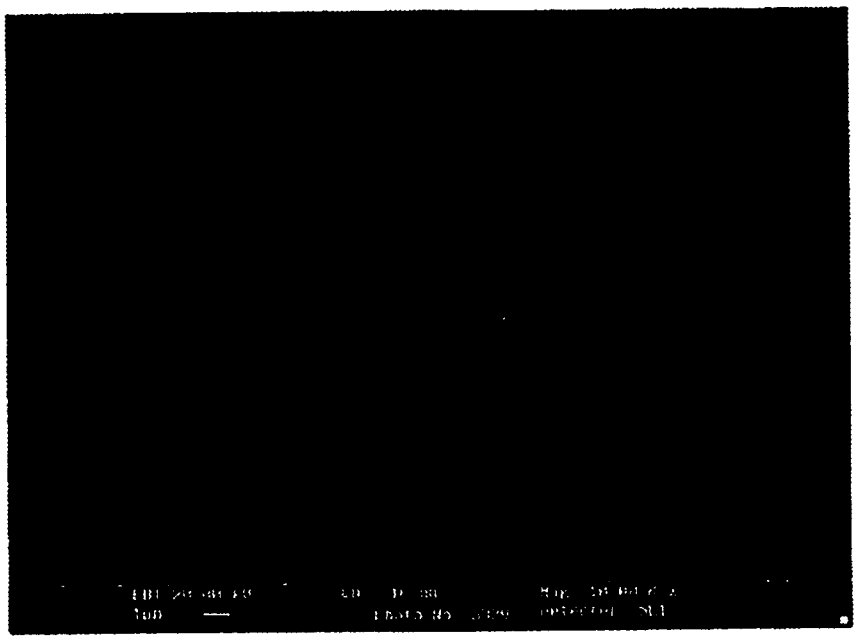
FIG. 6 illustrates the surface of an electroform after applying pulses of the second waveform.
Figure 7:
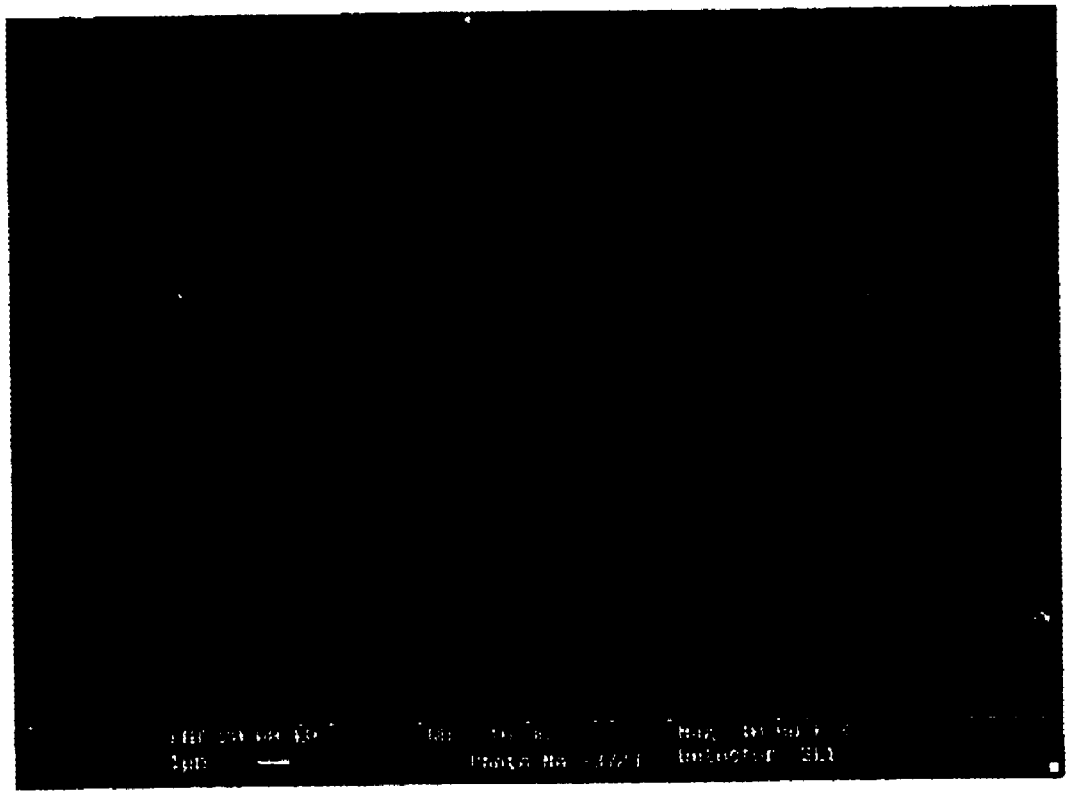
FIG. 7 illustrates the surface of an electroform after applying pulses of the third waveform.
Figure 8E:
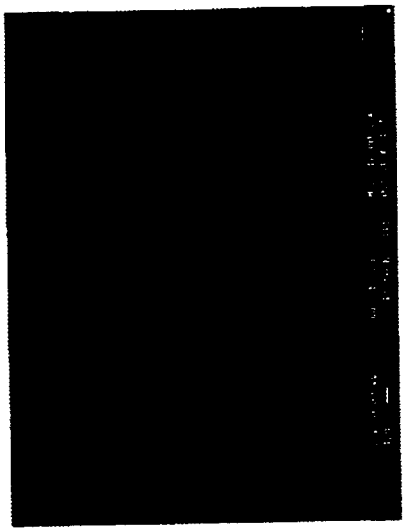
FIG. 8 shows comparative illustrations of surface finishes provided by prior art processes and processes according to the invention.
Figure 8C:
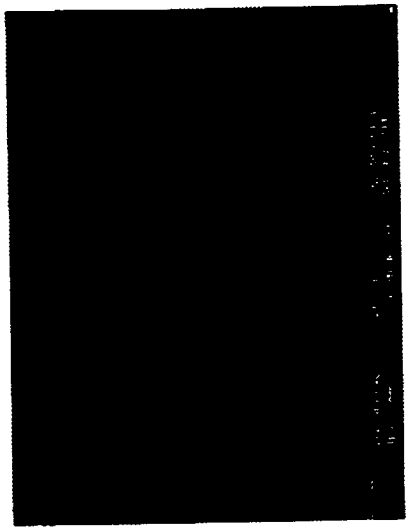
Figure 8A:
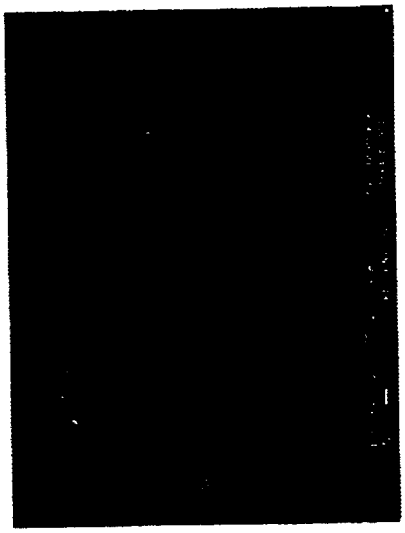
Figure 8F:
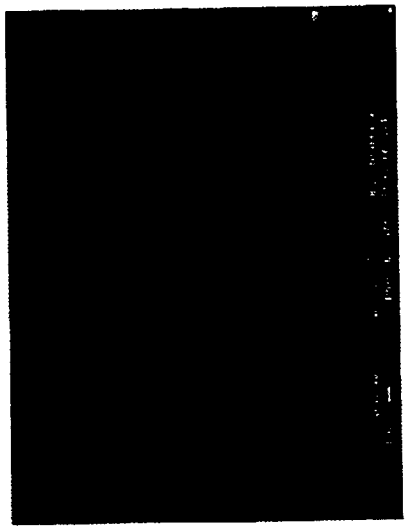
Figure 8D:
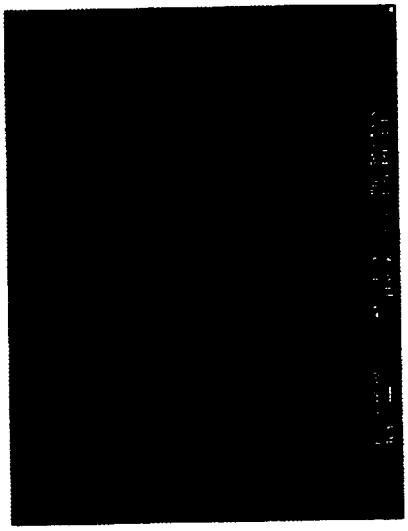
Figure 8B:
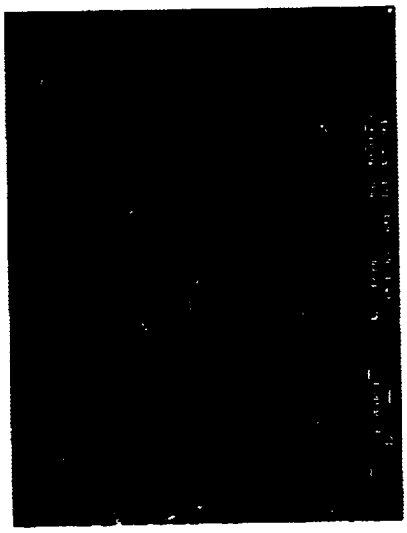

FIGS. 5, 6 and 7 show the surface of the electroform generated using the waveforms of FIGS. 2, 3 and 4 respectively; the condition used was a fixed deposition thickness condition. The thickness of the electroforms produced for the different waveforms is about 15 $\mu$m.

In FIG. 8, the illustrations provide comparisons, in pairs, between the electroform surfaces deposited when ramp down spikes are not applied (see FIGS. 8(*a*), 8(*b*) and 8(*c*)) and when ramp down spikes are applied, see FIGS. 8(*d*), 8(*e*) and 8(*f*). Thus, the refinement in grain structure is clearly illustrated by comparing FIGS. 8(*a*) and 8(*d*), 8(*b*) and 8(*e*), and 8(*c*) and 8(*f*). FIGS. 8(*d*), 8(*e*) and 8(*f*) correspond to FIGS. 5, 6, and 7 respectively. The improvements in surface finishing are clearly shown in Table 1.

We claim:

1. A nickel electrodeposition process for creating electroforms, the process comprising repetitively applying pulses of direct current between a cathode and anode at least partially immersed in an electrolyte, wherein each pulse has a waveform including a superposed ramp-down spike rising to a peak value and falling from the peak value at a constant rate.

2. The nickel electrodeposition process according to claim 1, wherein each pulse has a waveform including a rectangular pulse on which the ramp-down spike is superposed.

3. The nickel electrodeposition process according to claim 1, wherein each pulse has a waveform including a triangular pulse on which the ramp-down spike is superposed, the triangular pulse rising simultaneously with and at the same rate as the spike and falling at a rate lower than the constant rate at which the ramp-down spike falls.

4. The nickel electrodeposition process according to claim 1, wherein each pulse has a waveform including a triangular pulse on which the ramp-down spike is superposed, the triangular pulse rising and falling more slowly than the constant rate at which the ramp-spike falls.

5. A nickel electrodeposition process including repetitively applying current pulses of a cathodic current between a cathode and an anode at least partially immersed within an electrolyte, each of the current pulses including, superposed, a pulse and a spike, the pulse having a pulse duration and a pulse peak value, and the spike having a spike duration shorter than the pulse duration and rising to a spike peak value higher than the pulse peak value, the spike rising to the spike peak value at a first rate and falling to the pulse peak value at a constant second rate, slower than the first rate.

6. The nickel electrodeposition process according to claim 5 wherein the pulse duration is 5 milliseconds.

7. The nickel electrodeposition process according to claim 5 wherein the pulse has a rectangular waveform.

8. The nickel electrodeposition process according to claim 5 wherein the pulse has a triangular waveform, the pulse and the spike rising at the same time and at the first rate, the triangular pulse falling at a third rate smaller than the constant second rate.

9. The nickel electrodeposition process according to claim 5 wherein the pulse has a triangular waveform, the triangular waveform rising more slowly than the spike and falling at a third rate, slower than the constant second rate.

* * * * *